US005855275A

United States Patent [19]

Hunter et al.

[11] Patent Number: 5,855,275

[45] Date of Patent: Jan. 5, 1999

[54] TWO-TIERED CARTON FOR FLANGED ARTICLES

[75] Inventors: George Hunter, Chester; Paul Roosa, West Hurly, both of N.Y.; Ian Donegan, Cedar Knolls; Neal Van Hine, Butler, both of N.J.

[73] Assignee: Riverwood International Corporation, Atlanta, Ga.

[21] Appl. No.: 948,998

[22] Filed: Oct. 10, 1997

[51] Int. Cl.[6] ..... B65D 65/00

[52] U.S. Cl. ..... 206/429; 206/485.1; 206/431; 206/499

[58] Field of Search ..... 206/429, 431, 206/434, 499, 140, 485.1

[56] References Cited

U.S. PATENT DOCUMENTS

| | | | |
|---|---|---|---|
| 3,409,124 | 11/1968 | Jorgensen | 206/434 |
| 4,164,286 | 8/1979 | Sutherland | 206/434 |
| 4,756,419 | 7/1988 | Le Bras | 206/430 |
| 4,932,531 | 6/1990 | Bakx | 206/499 |
| 5,163,548 | 11/1992 | Domansky | 206/158 |
| 5,605,228 | 2/1997 | Baxter | 206/427 |

*Primary Examiner*—Paul T. Sewell
*Assistant Examiner*—Nhan T. Lam

[57] ABSTRACT

A carton for packaging two layers of stacked flanged tubs. A top panel overlies the tops of the upper tubs and a layer board lies between the two layers. Reinforcing flaps connected to the layer board are adhered to the side panels of the carton. The side panels contain openings through which portions of the tub flanges protrude. The bottom edge of the lower openings engage the underside of the tub flanges when lifting the package to thereby support the lower tubs.

8 Claims, 3 Drawing Sheets

TWO-TIERED CARTON FOR FLANGED ARTICLES

FIELD OF THE INVENTION

This invention relates to cartons for packaging articles such as tapered flanged tubs. More particularly, it relates to a carton designed to contain two tiers of articles.

BACKGROUND OF THE INVENTION

Items such as dairy products and desserts are commonly sold in tubs having tapered side walls and flanges extending out from the top of the tub. The top of the tub is usually covered by a foil membrane or lid attached to the flange. A variety of different cartons have been designed to package the tubs, usually including openings in the side panels through which the flanges partially extend. A recent trend is to package the tubs in two tiers. Such cartons can readily be handled since the tubs involved are fairly small in size. Despite their small size, however, the tubs can be quite heavy, and to package them in two tiers requires a carton which can support such a load without risk of product and package separation. In addition, other requirements should be met.

The package should maintain the tubs in upright position at all times, and for the purpose of product recognition substantial portions of the bottom row of tubs should be exposed. Also, the carton should be of a design that permits high speed packaging.

It is therefore an object of the invention to provide a carton that meets the above requirements.

BRIEF SUMMARY OF THE INVENTION

In accordance with the invention, upper and lower aligned flanged articles are packaged in a carton comprised of a top panel, side panels and a layer board. The layer board extends between the upper and lower articles so that it is in contact with the bottom portion of the upper article and the top portion of the lower article. The top panel is connected to the side panels by fold lines, and the side panels include upper and lower openings through which portions of the flanges of the upper and lower articles extend. In addition, means for connecting the side panels to the layer board are provided.

Preferably, the top panel includes outwardly extending tabs which at least partially cover the upper article flange and the layer board includes outwardly extending tabs which extend through the lower side panel openings and at least partially cover the lower article flange. The bottom edge of the lower side panel openings contacts the flange of an associated article to support the article when the package is lifted.

In the preferred embodiment the means for connecting the side panels to the layer board comprises downwardly extending reinforcing flaps foldably connected to the layer board, the flaps being adhered to portions of the side panels beneath the lower openings in the side panels.

The carton can be formed either from a two-piece blank, where the top and side panels are formed from one blank piece and the layer board and reinforcing flaps are formed from another blank piece, or from a unitary blank in which one of the side panels is foldably connected to an adjacent reinforcing flap. In either case the result is a carton which readily meets the object of the invention.

These and other features and aspects of the invention will be readily ascertained from the detailed description of the preferred embodiments described below.

DETAILED DESCRIPTION OF THE PREFERRED EMBODIMENTS

Figure 1:
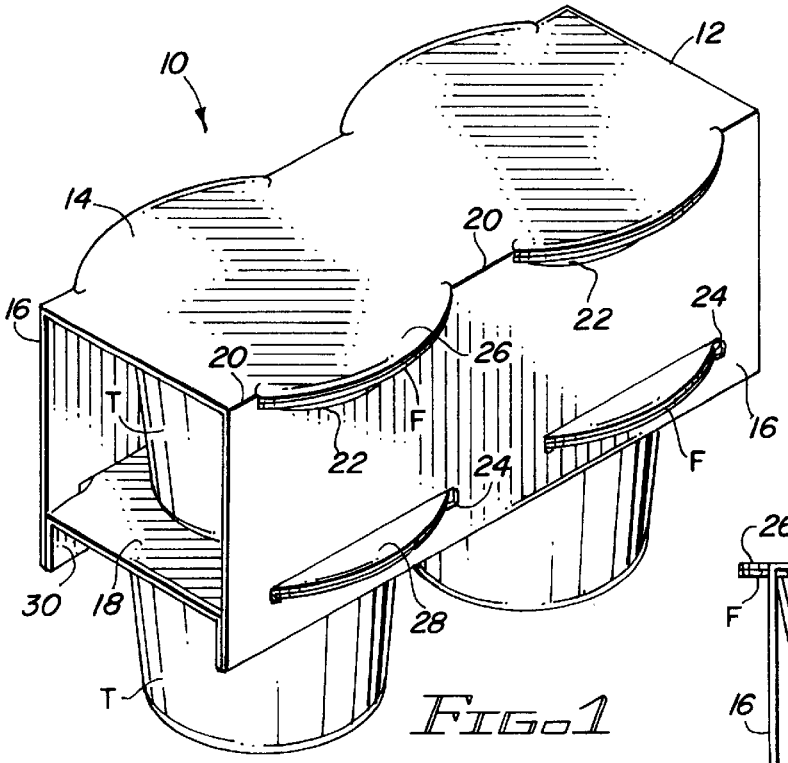
FIG. 1 is a pictorial view of a finished package formed from the carton of the invention.
Figure 3:
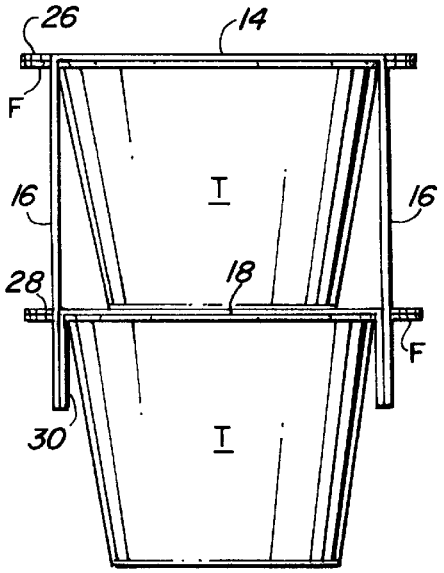
FIG. 3 is an end view of the package.
Figure 2:
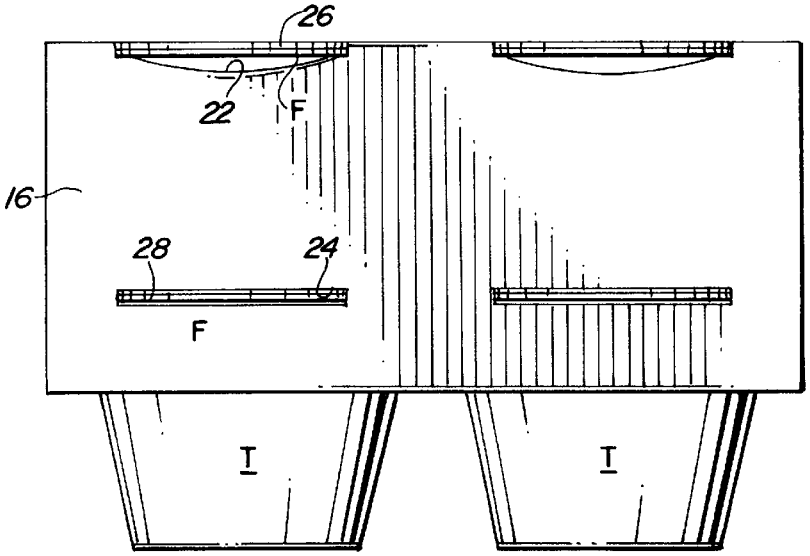
FIG. 2 is a side view of the package.

Referring to FIGS. 1–3, the package 10 is comprised of a carton 12 containing two tiers or layers of food tubs T. Each layer is made up of two tubs, with the tubs of the upper layer being aligned with the tubs of the lower layer. The tubs have slightly tapered sides and flanges F extending out from the top of the tubs beyond the sides. Typically, a foil membrane or lid is attached to the flanges to seal in the contents of the tub.

The carton includes a top panel 14 overlying the tops of the tubs in the upper layer, side panels 16 and a layer board 18 between the layers of tubs. The side panels 16, which are connected to the top panel 14 by spaced fold lines 20, contain openings 22 and 24 for receiving protruding portions of the tub flanges in the upper and lower layers, respectively. Outwardly extending top panel tabs 26 cover the protruding flanges of the upper layer of tubs, while similar outwardly extending layer board tabs 28 cover the protruding flanges of the lower layer of tubs. Completing the carton are reinforcing flaps 30 which engage the inner surface of the side panel portions below the layer board 18. It will be noted from FIG. 2 that the lower openings 24 are shaped somewhat differently than the upper openings 22 for reasons discussed below.

Figure 4A:
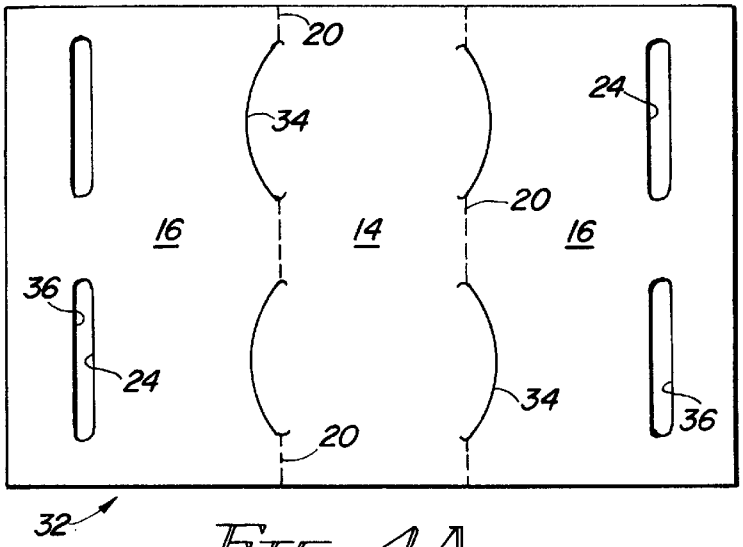
FIG. 4A is a plan view of a blank for forming the top and side portions of the carton.

Referring to FIG. 4A, the blank 32 is used to form the top and side panels of the carton. It is substantially rectangular in shape and, like all the blanks discussed herein, is comprised of paperboard of the type employed in the tub carton industry, although it may, if desired, be comprised of other materials having similar strength and flexibility properties. A central top panel section 14 is connected to adjacent side panel sections 16 by the top panel fold lines 20. The top panel fold lines 20 are interrupted by arcuate slits 34 which form the top panel tabs 26 when the blank is folded about the fold lines 20. The flange openings 24 are partially defined by edges 36, which become the lower edges of the openings in a carrier formed from the blank, and which are substantially parallel to the fold lines 20. This makes the edges 36 substantially parallel to the tub flanges in a carrier formed from the blank. The blank 32 is used in cooperation with the layer board blank 38 of FIG. 4B. This blank is also substantially rectangular in shape and includes a central layer board section 18 connected by fold lines 40 to adjacent reinforcing flaps 30. As in the case of the blank 32, the fold lines 40 in the blank 38 are interrupted by arcuate slits 42.

Figure 5:
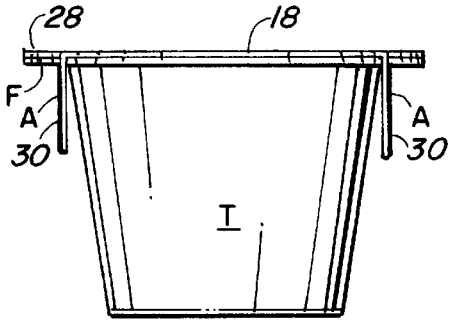
FIG. 5 is an end view illustrating the application of the layer board blank to the bottom tier of tubs.

To form the package of FIG. 1 the layer board blank 38 is placed on top of the two tubs comprising the lower tier of the package so that the arcuate slits 42 are substantially aligned with the edges of the tub flanges. The outer portions of the blank 38 are then pivoted down about the fold lines 40, creating the downwardly extending reinforcing flaps 30 and the outwardly extending tabs 28 of the carton. It will be understood that the openings in the layer board blank through which the tub flanges extend are created by the separation of the layer board tabs from the reinforcing plies along the slits 42, which occurs during this folding process. This interim stage of formation is illustrated in FIG. 5. The tubs comprising the upper layer of the package are then placed on the layer board directly over the lower tubs and the blank 32 is placed on top of them. Adhesive is applied to the outer face of the reinforcing flaps 30, as indicated by the coating layer A in FIG. 5, and the blank 32 is folded about the fold lines 20, thereby forming the side panels 16, the outwardly extending tabs 26 and the side panel openings 22. The lower portions of the side panels 16 contact the adhesive on the reinforcing flaps, bonding the reinforcing flaps to the side panels, thus producing the package shown in FIG. 1.

The tubs are prevented from moving out of the package by the engagement of the protruding tub flanges with the ends of the openings 22 and 24, and the membrane or lid-like covering on the top of the tubs is protected against damage by the overlying tabs 26 and 28. The tubs in the upper layer are supported by both the layer board 18 and the tubs in the lower layer. When the package is lifted, however, it will be seen, referring especially to FIG. 1 and 2, that the weight of the lower tubs is borne by the lower edges 36 of the side panel openings 24. This requires the lower edges 36 to contact the underside of the lower tub flanges along substantial portions of the flanges. Preferably, this is accomplished by making the lower edges of the openings 24 substantially parallel to the underside of the tub flanges, which makes the lower edges be also substantially parallel to the fold lines 20 and 40. The two-ply sections of the side panels below the openings 24 formed by the side panels 16 and the reinforcing flaps 30 further strengthen the side panels in this critical area.

Figure 4B:
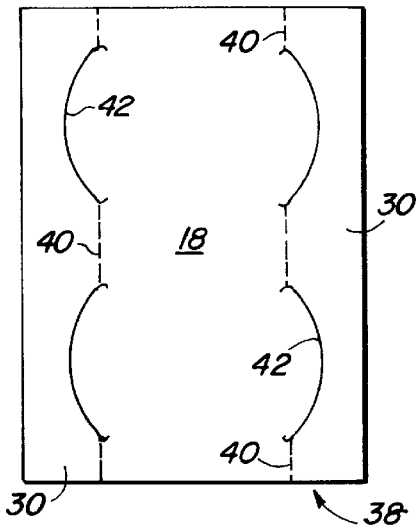
FIG. 4B is a plan view of a blank for forming the layer board of the carton.
Figure 6:
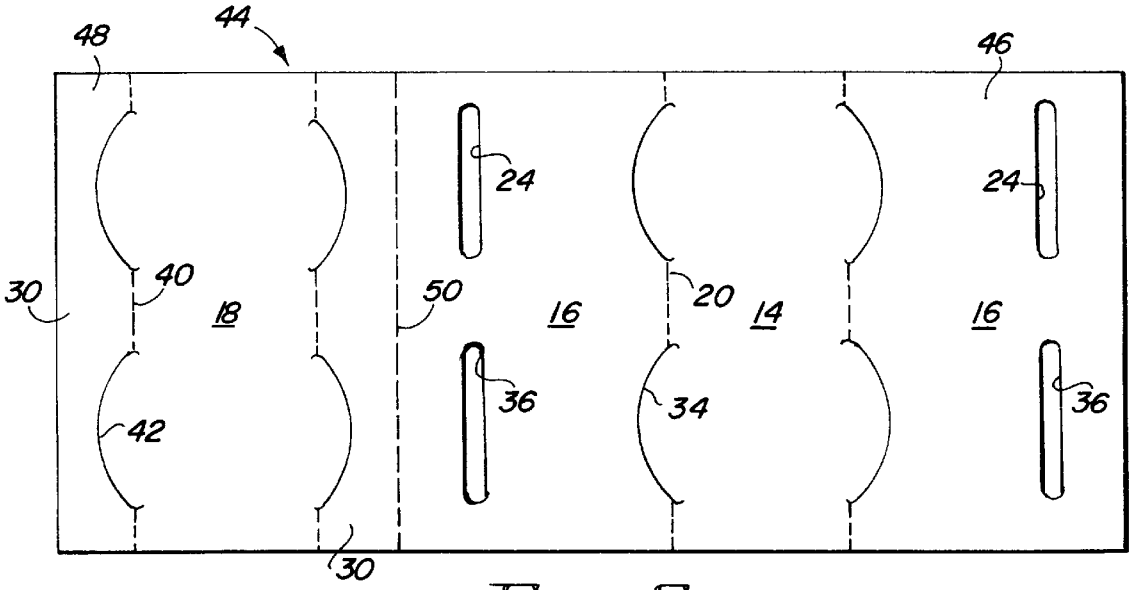
FIG. 6 is a plan view of a unitary blank for forming the carton of FIG. 1.

Instead of forming the carton from the two-piece blank illustrated in FIGS. 4A and 4B, the carton can also be formed from the unitary blank illustrated in FIG. 6. The blank 44 is substantially rectangular in shape and consists basically of a first section 46 connected to a second section 48 by fold line 50. The first section 46 is substantially identical to the blank 32 of FIG. 4A, containing fold lines 20, slits 34 and flange openings 24, while the second section 48 is substantially identical to the blank 38 of FIG. 4B, containing fold lines 40 and slits 42. The fold line 50 is parallel to the fold lines 20 and 40.

Figure 8:
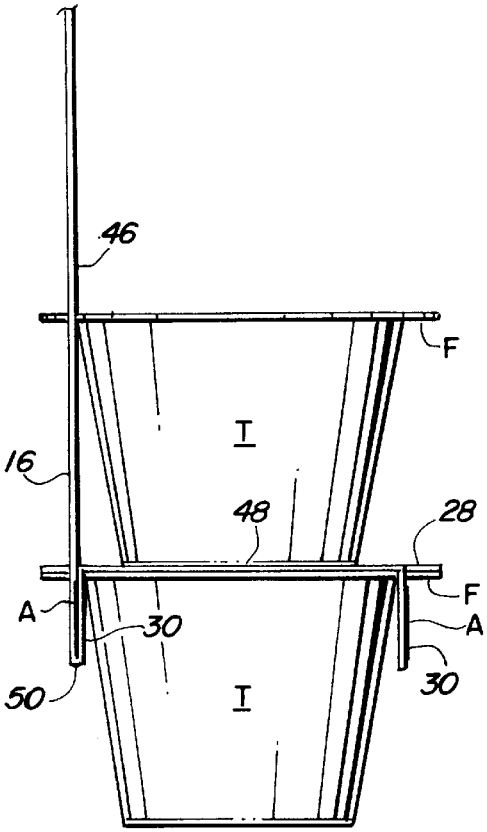
FIG. 8 is a partial end view illustrating a subsequent step in forming a carton from the blank of FIG. 6.
Figure 7:
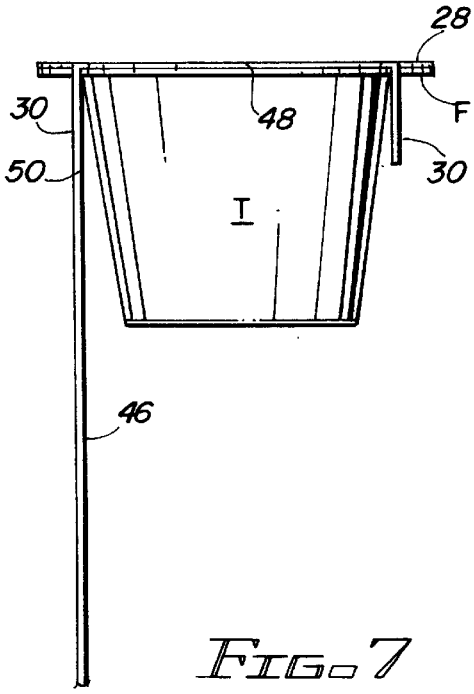
FIG. 7 is a partial end view illustrating a first step in forming a carton from the blank of FIG. 6.

To form a package from the blank 44, the section 48 of the blank is placed on top of the two tubs comprising the lower layer of the package, after which the portions of the blank section 48 lying outwardly of the fold lines 40 are pivoted down about the fold lines 40, creating the downwardly extending reinforcing flaps 30 of the carton and the outwardly extending tabs 28. This interim stage of formation is illustrated in FIG. 7. The tubs comprising the upper layer of the package are then placed on the blank section 48 directly over the lower tubs and the blank section 46 is folded up about the fold line 50 to form the interim state shown in FIG. 8. As the side panel portion of the blank section 46 is folded up into place, the tub flanges in the bottom layer will extend through the associated openings 24. Adhesive A will have been applied to the outer face of the reinforcing flap 30 adjacent the fold line 50 to adhere the reinforcing flap to the upwardly folded blank section 46. Adhesive A is then applied to the other reinforcing flap 30 and the blank section 46 is folded about the fold lines 20, forming the other side panel 16 and the outwardly extending tabs 26 of the carton. The flanges of the upper tubs at that time will extend through the openings 22 formed by the folding along the fold lines 20. This method produces the package shown in FIG. 1. The only difference between the packages produced by the two different methods is that in the carton produced by the unitary blank one of the reinforcing plies is connected to the side panel by a fold line, whereas in the carton produced by two blanks neither reinforcing ply is so connected. There is no functional difference between the two, however, inasmuch as in both cases the reinforcing plies are bonded to the side panels by adhesive.

Figure 9:
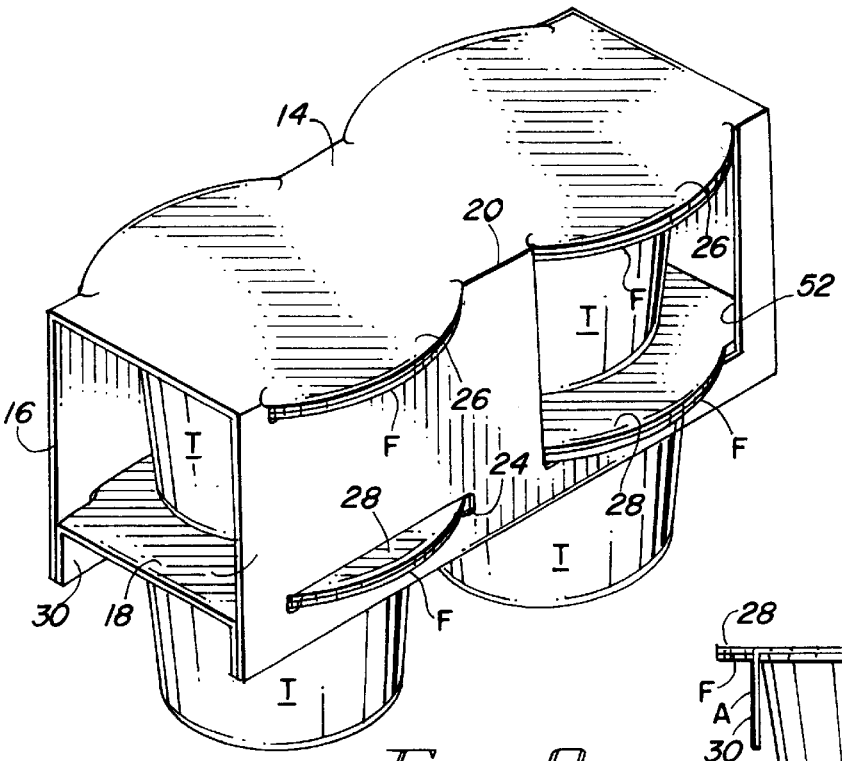
FIG. 9 is a pictorial view of a package incorporating another embodiment of the carton.

Referring to FIG. 9, a modified carton is illustrated in which a window cutout 52 is provided in the side panels adjacent one of the upper level tubs. The purpose of the windows is to expose one of the tubs for marketing appeal. The remainder of the side panels provides ample space for billboards. The bottom edge of the windows provides the same function as the bottom edge of the lower openings 24 in the first embodiment, engaging the underside of the lower tub flanges to support the lower layer of tubs when the package is lifted. The area of the side panels framing the windows and the two-ply reinforced portions of the side panels are adequate to readily support the tubs without risk of tearing or other failure. A window design would not be employed, however, in a package having only one tub in each layer.

The invention provides a simple, economical design for a two-tiered tub package which can be formed from either a two-piece blank or a unitary blank and which lends itself to rapid formation on existing packaging machines. Although the invention has been described in the context of a carton for packaging two layers of tubs consisting of two tubs per layer, it will be understood that the same principles may be employed in designing a carton for only a single tub per layer or for more than two tubs per layer. While the invention has been described in connection with the packaging of food tubs, it will be understood that the carton could be designed to hold other types of flanged articles as well.

It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A package, comprising:

upper and lower aligned articles, each article having a bottom portion, a top portion and a flange extending outwardly from the top portion;

a layer board between the upper and lower articles, the layer board being in contact with the bottom portion of the upper article and the top portion of the lower article;

a top panel connected to opposite side panels by fold lines, said side panels terminating at a location below the flange of the lower article and above the bottom of the lower article;

the side panels including upper and lower openings through which portions of the flanges of the upper and lower articles extend;

said top panel including outwardly extending tabs at least partially covering the outwardly extending flange of the upper article and said layer board including outwardly extending tabs at least partially covering the outwardly extending flange of the lower article, the tabs of said layer board extending through the lower openings in the side panels; and means for connecting the side panels to the layer board.

2. A package as defined in claim 1, wherein the lower openings in the side panels include a bottom edge located adjacent to the outwardly extending article flange of the associated article so as to engage the article flange when the package is lifted.

3. A package as defined in claim 1, wherein the means for connecting the side panels to the layer board comprises downwardly extending flaps foldably connected to the layer board, the flaps being adhered to portions of the side panels beneath the lower openings in the side panels.

4. A package as defined in claim 3, wherein the layer board flaps include openings aligned with the lower openings in the side panels.

5. A package as defined in claim 4, wherein each of the side panels and the layer board flaps has a lower edge, the lower edge of one of the flaps being foldably connected to the lower edge of an adjacent side panel.

6. A package as defined in claim 1, wherein each layer of articles includes two adjacent articles, each side panel adjacent one of the upper articles containing the aforesaid openings therein, each side panel adjacent the other upper article containing a window opening through which said other article is visible, each window opening having a bottom edge in the same plane as the bottom edge of the lower opening in the side panel.

7. A two-piece blank for forming a carton for packaging upper and lower aligned articles, each article having a bottom portion, a top portion and a flange extending outwardly from the top portion, comprising:

one of the blank pieces being comprised of a central top panel section connected by fold lines to side panel sections, the side panel sections containing openings located so as to receive portions of the flange of the lower article in a carton formed from the blank, said side panel sections being dimensioned to terminate below the flange portion of a lower article in a carton formed from the blank and above the bottom of said lower article in a carton formed from the blank;

the top panel section fold lines being interrupted by outwardly extending slits which, when the top panel section is folded along the top panel section fold lines, create openings In the side panel sections located so as to receive portions of the flange of the upper article in a carton formed from the blank;

the other blank piece being comprised of a central layer board section connected by fold lines to reinforcing flaps, the layer board section being designed to lie between the upper and lower articles in a carton formed from the blank, in contact with the bottom portion of the upper article and the top portion of the lower article; and the layer board section fold lines being interrupted by outwardly extending slits which, when the layer board section is folded along the layer board section fold lines, create openings in the reinforcing flaps located so as to receive portions of the flange of the lower article in a carton formed from the blank, said top panel section including outwardly extending tabs at least partially covering the outwardly extending flange of an upper article in a carton formed from the blank and said layer board section including outwardly extending tabs at least partially covering the outwardly extending flange of a lower article in a carton formed from the blank, the tabs of said layer board section extending through the openings for the lower article flanges in said side panel section in a carton formed from said blank.

8. A unitary blank for forming a carton for packaging upper and lower aligned articles, each article having a bottom portion, a top portion and a flange extending outwardly from the top portion, comprising:

a top panel section connected by fold lines to side panel sections, the side panel sections containing openings located so as to receive portions of the flange of the lower article in a carton formed from the blank, said side panel sections being dimensioned to terminate below the flange portion of a lower article in a carton formed from said blank and above the bottom of said lower article in a carton formed from said blank;

the top panel section fold lines being interrupted by outwardly extending slits which, when the top panel section is folded along the top panel section fold lines, create openings in the side panel sections located so as to receive portions of the flange of the upper article in a carton formed from the blank;

a central layer board section connected by fold lines to reinforcing flaps, the layer board section being designed to lie between the upper and lower article in a carton formed from the blank, in contact with the bottom portion of the upper article and the top portion of the lower article;

the layer board section fold lines being interrupted by outwardly extending slits article; and the layer board section fold lines being interrupted by outwardly extending slits which, when the layer board section is folded along the layer board section fold lines, create openings in the reinforcing flaps located so as to receive portions of the flange of the lower article in a carton formed from the blank, said top panel section including outwardly extending tabs at least partially covering the outwardly extending flange of an upper article in a carton formed from the blank and said layer board section including outwardly extending tabs at least partially covering the outwardly extending flange of a lower article in a carton formed from the blank, the tabs of said layer board section extending through the openings for the lower article flanges in said side panel section in a carton formed from said blank.

* * * * *